US005472251A

United States Patent [19]

Deininger

[11] Patent Number: 5,472,251

[45] Date of Patent: Dec. 5, 1995

[54] DEVICE ATTACHING AND HANGING HOOK

[75] Inventor: Eric L. Deininger, Blue Point, N.Y.

[73] Assignee: Apple Sports, Inc., Ronkonkoma, N.Y.

[21] Appl. No.: 293,139

[22] Filed: Aug. 19, 1994

[51] Int. Cl.[6] ..... A63B 47/02

[52] U.S. Cl. ..... 294/19.2; 273/32 F

[58] Field of Search ..... 294/19.1, 19.2, 294/24, 26; 280/819, 821; 224/252, 269; 273/32 F, 162 E

[56] References Cited

U.S. PATENT DOCUMENTS

| | | | |
|---|---|---|---|
| 334,993 | 1/1886 | Smith . | |
| 458,614 | 1/1891 | Buddenberg . | |
| 2,482,294 | 9/1949 | Sandor | 294/19 |
| 2,548,201 | 4/1951 | Cromley | 224/252 X |
| 3,326,433 | 6/1967 | Koch | 224/252 X |
| 3,663,049 | 5/1972 | James | 294/19 |
| 3,777,933 | 12/1973 | Joliot | 224/252 X |
| 3,992,021 | 11/1976 | Tobin | 280/821 |
| 4,004,818 | 1/1977 | Ramillon | 280/821 |
| 4,522,438 | 6/1985 | Logue | 294/19 |
| 4,610,373 | 9/1986 | Sherboady | 221/155 |
| 4,659,125 | 4/1987 | Chuan | 294/19.2 |
| 4,830,248 | 5/1989 | Pommenville | 224/269 |
| 5,188,409 | 2/1993 | Forey | 294/19 |
| 5,341,975 | 8/1994 | Marinescu | 224/269 X |

*Primary Examiner*—Dean Kramer
*Attorney, Agent, or Firm*—Furgang & Milde

[57] ABSTRACT

A hook is provided for the grip end of a rod-like golf accessory in the form of a golf ball retriever. The grip outer surface is formed with a sinuous outer surface having concave and convex sections. An arm extends out proximate a top of the grip and a leg extends out from the arm down parallel to the grip and spaced from an outer surface of the grip. A distal end of the leg is angled in towards the grip surface to provide a narrowed entry into the space between the hook legs and the grip outer surface. The hook arm and legs are almost as wide as the narrowest part of the grip relatively thick to provide substance to the hook and somewhat flexible to facilitate flexure of a distal end of the hook leg when hooking the device over an upper edge of a golf bag.

19 Claims, 1 Drawing Sheet

DEVICE ATTACHING AND HANGING HOOK

BACKGROUND OF THE INVENTION—FIELD OF APPLICATION

This invention relates to hooks and, more particularly to hooks forming part of a device and utilized to attach, hang and/or suspend the device from an article that may, in some way, be related to the device.

BACKGROUND OF THE INVENTION—DESCRIPTION OF THE PRIOR ART

Quite often the enjoyment of a pastime, such as a sport, requires the utilization of equipment related to that sport. Playing tennis may create the need for tennis racquets, balls and articles such as bags to carry those items. Tennis ball holding and dispensing devices are also available to facilitate the availability of a collection of tennis balls that seem to be required when playing tennis. Some tennis ball holding and dispensing devices are equipped with hooks to facilitate hanging the device on the fence that usually surrounds the tennis court. One example of such a device is shown and described in U.S. Pat. No. 4,522,438 patented to DeWitt M. Logue on Jun. 11, 1985 for "Retriever And Dispenser For Deformable Balls." However, hanging hooks of the type shown by DeWitt M. Logue in no way provide a gripping coaction between any part of the hook and the article (fence) from which the device carrying the hook is to be hung.

There is no question but that it is old to equip a device with a hook or handle such as those shown respectively in U.S. Pat. No. 334,993 patented to F. B. Smith on Jan. 26, 1986 for "Handle" and in U.S. Pat. No. 458,614 patented to H. C. Buddenberg on Sep. 1, 1891 for "Gripping Device." However, while the curved or bent over ends of devices such as these may serve to facilitate hanging the device up they perform no function of coaction between the device and the article upon which the device is to be hung to facilitate or enhance retention of the device upon the article upon which the device is so hung.

Golf is another sport that requires the use of balls and equipment and necessitates the use of an article, such as a golf bag, to retain and facilitate transport of the golf balls and golf clubs. Other accessories are sometimes also required to play and enjoy golf whether as an amateur or as a professional. One such device might be a golf ball retriever such as those shown and described in: U.S. Pat. No. 2,482,294 patented to W. C. Sandor on Sep. 20, 1949 for "Golf Ball Retriever"; in U.S. Pat. No. 3,663,049 patented to C. N. James on May 16, 1972 for "Golf Ball Retrieval And Storage Device"; and in U.S. Pat. No. 5,188,409 patented to D. J. Forey on Feb. 23, 1993 for "Golf Ball Retriever." However, neither the wire operating handle of the W. C. Sandor device, nor the arm resting portion of the C. N. James device, nor the sleeve of the D. J. Forey device facilitate attachment and hanging of the respective devices on their associated articles (i.e. golf bags). In fact, none of these devices appears to be equipped with a handle for attaching the device to a golf bag or other associated article whatsoever.

W. A. Sherboady in U.S. Pat. No. 4,610,373 paented on Sep. 9, 1986 for "Ball Dispenser" shows and describes a device utilized to retain and dispense golf balls. The handle provided for the FIG. 1 W. A. Sherboady device obviously presses snugly against the side of the device, could present unacceptable problems in use and could possibly damage the golf bag when hooked thereon while the FIG. 4 W. A. Sherboady device merely provides a clip of tough plastic that does not appear to at all be flexible and which as such may present unacceptable problems when hooking the device onto its carrier, golf bag or the like.

SUMMARY OF THE INVENTION

It is therefore an object of this invention to provide a new and novel hook for hanging a device, implement or the like onto an article, object, carrier or the like.

It is another object of this invention to provide a new and novel hanging hook for a device.

It is yet another object of this invention to provide a new and novel hanging or attaching hook for an accessory that may be utilized when engaging in a sport.

It is yet still another object of this invention to provide a new and novel hanging or attaching hook for a golf accessory.

It is a further object of this invention to provide a new and novel attaching or hanging hook for a golf ball retriever.

It is yet a further object of this invention to provide a new and novel attaching or hanging hook for attahing or hanging a golf ball retriever onto a golf bag.

It is still a further object of this invention to provide a new and novel hook for positioning a device onto a carrier or article wherein the hook and device coact to facilitate disposition of the hook and device with respect to the carrier or article while at the same time providing some gripping action therebetween.

Other objects, features and advantages of the invention in its details of construction and arrangement of parts will be seen from the above and from the following description of thep preferred embodiment when considered with the drawing and from the appended claims.

DESCRIPTION OF THE PREFERRED EMBODIMENT

Figure 1:
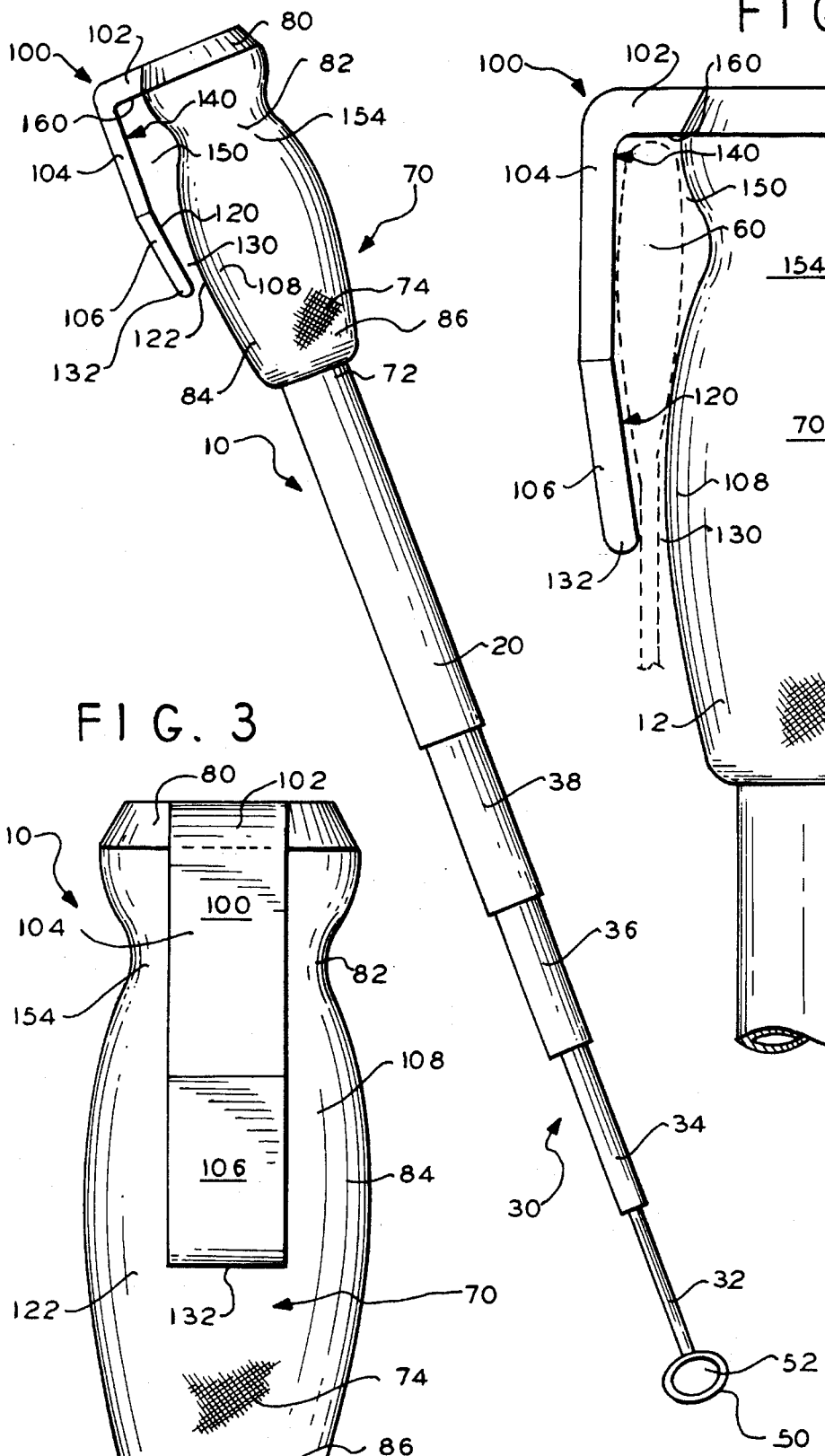
FIG. 1 is a perspective sketch of a golf ball retriever provided with a hanging and attaching hook incorporating the instant invention.

With reference to FIG. 1 there is generally shown at 10 a device in the form of a golf ball retriever having a tubular main shaft 20 that is hollow inside and is sized and configured to receive a set 30 of telescoping extensions 32, 34, 36 and 38. Extensions 32, 34, 36 and 38 are shown in their extended disposition with extension 38 extending out from main shaft 20, extension 36 extending out from extension 38, extension 34 extending out from extension 36 and extension 32 extending out from extension 34. Each extension 38, 36, 34 and 32 is of hollow tubular construction and of a size and configuration to be recieved within the extension it extends from and to receive the extension that extends out from it. Extension 32 may be of solid rod-like construction because it is the last extension member. Extensions 38, 36, 34 and 32 may be fabricated from suitable plastic or from metal such as aluminum, steel or the like. They may be of any suitable cross-sectional configuration with circular being preferred. The construction of main shaft 20 and extension members 38–32 is substantially conventional in that the respective members are interconnected for telescopic movement with respect to each other but in such manner that they do not separate from each other.

A ring or cup 50 is disposed at the free end of extension member 32. Ring 50 is fabricated from any suitable material such as plastic or the like and with an opening or through hole 52 sized to removably receive a golf ball.

It will thus be seen that golf ball retriever device 10 is pole or rod-like in configuration and can be used by extending telescoping extensions 38–32 to a desired length and then manipulating device 10 to scoop a golf ball (not shown) into space 52 of ring 50 from a water hazard, a rough or similar difficult to reach location. After so retrieving a golf ball or balls extensions 32–38 are collapsed into main shaft 20 and device 10 can be returned to its place of storage probably hanging from an upper end 60 of a golf bag (only upper end 60 shown in FIG. 2).

A grip 70 (FIGS. 1–3) is provided for device 10 at an end 72 of main shaft 20. Grip 70 is provided with an outer surface 74 that facilitates gripping by a human hand and may be fabricated from a plastic or other material suitable for the purpose.

The configuration of grip 70 is sinuous to facilitate gripping of device 10 and hanging of device 10 onto upper edge 60 of a golf bag. More specifically, grip 70 is fabricatd with a top portion 80, a first section 82 that is concave, and a second section 84 that is convex and terminates at 86 where grip 70 meets main shaft 20. The horizontal cross-sectional configuration of grip 70 is circular.

A hook 100 preferably fabricated of the same material as grip 70 and integral therewith includes an arm 102 that extends out from top 80 of grip 70 at right angle thereto. A first leg section 104 extends down from arm 102 at substantially a right angle thereto and into a second leg section 106 that extends down from leg section 104 while extending inwardly toward grip 70 proximate a respectively wide part 108 of bulge or convex section 84 of grip 70. An inner surface 120 (FIGS. 1 and 2) is spaced from an outer surface 122 of grip 70 by a first space 130 proximate a tip end 132 of hook 100. An inner surface 140 (FIGS. 1 and 2) of first leg section 104 of hook 100 is spaced from outer surface 122 of grip 70 proximate first or concave section 82 by a second space 150 that is relatively larger than space 130. The construction of leg sections 104, 106 permits flexure of same towards and away from surface 122 of grip 70.

Figure 2:
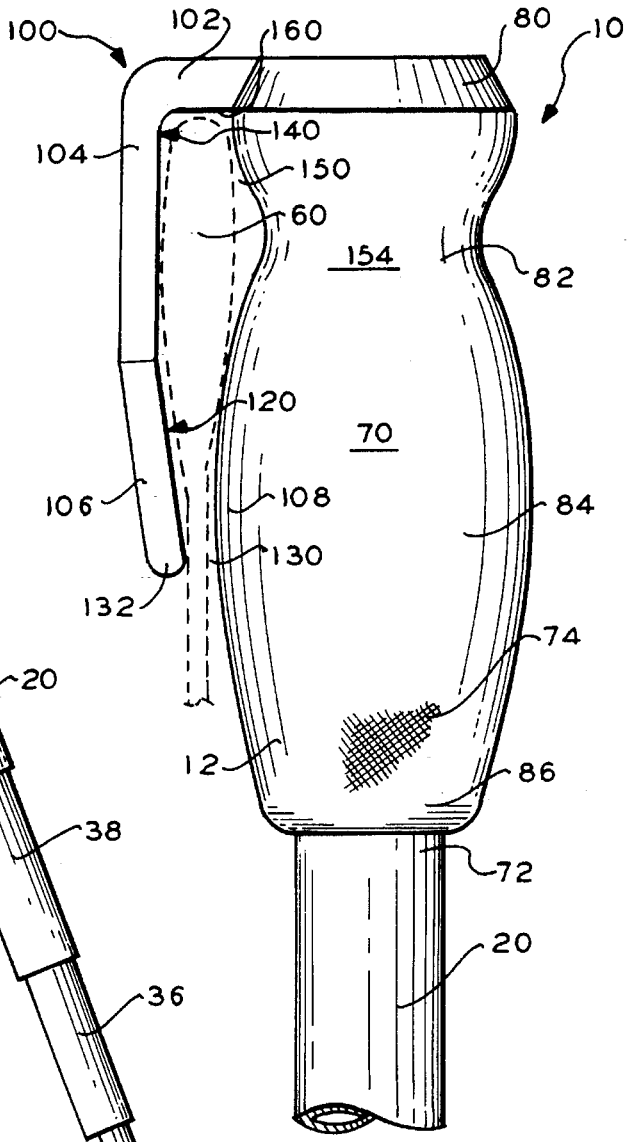
FIG. 2 is an enlarged vertical slide elevation of the golf ball retriever of FIG. 1 showing its grip end and the hanging and attaching hook of the instant invention applied thereto.
Figure 3:
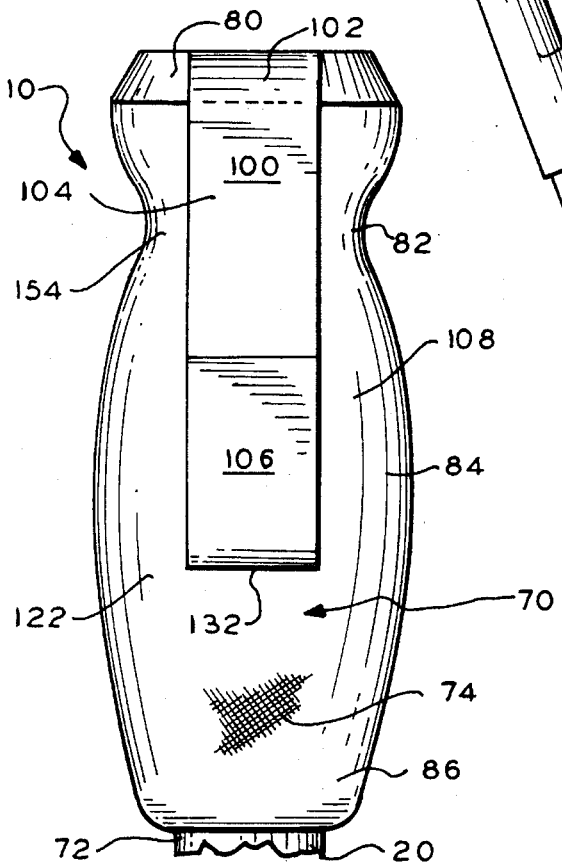
FIG. 3 is an enlarged vertical front elevation of the grip end and hanging and attaching hook of FIGS. 1 and 2.

It should be noted from FIG. 3 that hook 100 is relatively wide compared to the width of grip 70 and in almost as wide as a narrow portion 154 of grip 70. Hook 100 is relatively thick as best seen in FIGS. 1 and 2.

Space 150 is relatively wider the entry space 130 to accommodate a relatively thick upper end 60 of a golf bag which may include a reinforcement proximate its upper end while space 130 need not be as wide as space 150 because below its upper end 60 a golf bag is usually only as thick as the material from which the golf bag is fabricated.

The resilience of hook 100 towards and away from grip 70 and especially of second leg section 106 thereof facilitates entry of end 60 of a golf bag through space 130 to permit upper end 60 of the golf bag to be received in space 150 and an inner surface 160 of arm 102 to rest upon upper end 60 of a golf bag. Thus, device 10 is hooked onto and held in place on a golf bag either inside or outside of the golf bag.

It should be seen that the instant hook construction can be applied to a grip for any device and that such hook construction can be utilized to hang and secure such device to any appropriate carrying, support or other article or structure.

While the invention has been described with a preferred embodiment it is not intended to limit the invention to the particular form set forth, but, on the contrary, it is intended to cover such alternatives, modifications and equivalents as may be included within the spirit and scope of the invention as defined by the appended claims.

What is claimed is:

1. A hook for a rod-like sports device having at least a grip; comprising:

(a) a hook arm extending out a first predetermined distance from the grip of the device;

(b) a hook leg extending in a predetermined direction and for a second predetermined distance from said hook arm and so that an outer surface of said hook leg is proximate to the grip but spaced from the grip;

(c) said hook leg including a distal end;

(d) the grip including a sinuous outer surface having top, concave, and convex portions;

(e) a first section of said hook leg being disposed to be spaced from said concave portion of said outer surface of the grip;

(f) a second section of said hook leg being disposed to be spaced from said convex portion of the grip and terminating at said distal end; said distal end being spaced from said concave portion of said outer surface of the grip and being also spaced from an apex of said convex portion and extending past said apex of said convex portion to a side of said convex portion furthest removed from said concave portion; the space between said distal end of said second section of said hook leg and said outer surface of the grip being less than the space between said first section of said hook leg and said outer surface of the grip.

2. The hook of claim 1, wherein said hook leg includes a first hook leg portion that extends from said hook arm and a second hook leg portion that extends from said first hook leg portion at an angle to said first hook leg portion.

3. The hook of claim 2, wherein said hook arm and said hook leg are integral and unitary.

4. The hook of claim 3, wherein at least said hook leg is relatively flexible.

5. The hook of claim 1, wherein said second hook leg section extends at an angle from said first hook leg section and so as to extend towards said outer surface of the grip.

6. The hook of claim 5, wherein said hook arm and said hook leg are relatively wide.

7. The hook of claim 6, wherein said hook arm and said hook leg are relatively thick.

8. The hook of claim 6, wherein said hook leg is relatively flexible.

9. The hook of claim 8, wherein said hook arm and said hook leg are formed integral and unitary with said grip.

10. A rod-like sports device including a grip; comprising:

(a) a sinuous outer grip surface for the grip of the rod-like device, said outer surface having top, concave, and convex portions;

(b) a hook arm extending out a first predetermined distance from said grip outer surface proximate said top portion thereof; and (c) a hook leg extending from said hook arm in a predetermined direction and so as to be spaced from said grip outer surface;

(d) said hook leg including a distal end that is also spaced from said grip outer surface by an amount which is less than the spacing of the rest of said hook leg from said grip outer surface; said distal end also being spaced from an apex of said convex portion of the grip outer surface and extending past said apex of said convex portion to a side of said convex portion furthest removed from said concave portion.

11. The device of claim 10, wherein said hook leg includes a first hook leg portion that extends from said hook arm and a second hook leg portion that extends from said first hook leg portion at an angle to said first hook leg portion.

12. The device of claim 11, wherein Said hook arm and said hook leg are integral and unitary.

13. The device of claim 12, wherein at least said hook leg is relatively flexible.

14. The device of claim 13, wherein said hook arm is formed integral and unitary with said grip.

15. The device of claim 14, wherein said hook arm and said hook leg are relatively wide when compared to said grip.

16. The device of claim 15, wherein said hook arm and said hook leg are relatively thick.

17. The device of claim 16, wherein said grip is for a golf ball retrieving device.

18. The device of claim 17, wherein said hook is configured to be disposed over and received by an upper edge of a golf bag.

19. The device of claim 18, wherein an upper space is provided between said first leg portion and said grip outer surface to receive the upper edge of a golf bag upon which the device is to be hung and a lower space is provided between said second leg portion and said grip outer surface to receive the material of a golf bag below an upper edge of the golf bag; said hook leg portions being relatively flexible to permit passage of same over an upper edge of a golf bag.

* * * * *